US010240564B2

(12) United States Patent
Nakamura

(10) Patent No.: US 10,240,564 B2
(45) Date of Patent: Mar. 26, 2019

(54) INTAKE MANIFOLD FOR INTERNAL COMBUSTION ENGINE

(71) Applicant: TOYOTA JIDOSHA KABUSHIKI KAISHA, Toyota-shi (JP)

(72) Inventor: Atsuro Nakamura, Toki (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/667,968

(22) Filed: Aug. 3, 2017

(65) Prior Publication Data

US 2018/0045151 A1 Feb. 15, 2018

(30) Foreign Application Priority Data

Aug. 15, 2016 (JP) ..... 2016-159269

(51) Int. Cl.
*F02M 35/116* (2006.01)
*B22D 17/00* (2006.01)
(Continued)

(52) U.S. Cl.
CPC ..... *F02M 35/116* (2013.01); *B22D 17/00* (2013.01); *B22D 23/02* (2013.01); *F02M 35/108* (2013.01); *F02M 35/1047* (2013.01)

(58) Field of Classification Search
CPC ..... F02M 35/116; F02M 35/1047; F02M 35/10006; F02M 35/10032;
(Continued)

(56) References Cited

U.S. PATENT DOCUMENTS 4,925,510 A * 5/1990 Hojo ..... F02M 35/10321 156/153
5,544,629 A * 8/1996 Ohata ..... F02B 75/22 123/184.36
(Continued)

FOREIGN PATENT DOCUMENTS

| | | |
|---|---|---|
| JP | 2-7351 U | 1/1990 |
| JP | 2010-14018 | 1/2010 |
| JP | 2010-249124 | 11/2010 |

OTHER PUBLICATIONS

Office Action dated May 22, 2018 in Japanese Patent Application No. 2016-159269 (submitting English language translation only).

*Primary Examiner* — Jacob Amick
(74) *Attorney, Agent, or Firm* — Oblon, McClelland, Maier & Neustadt, L.L.P.

(57) ABSTRACT

Provided is an intake manifold for an internal combustion engine, the intake manifold including an upstream portion, a first downstream portion, and a second downstream portion. The upstream portion includes a first upstream passage and a second upstream passage. The first downstream portion includes a first downstream passage configured to communicate the first upstream passage with an intake port of a first cylinder head. The second downstream portion includes a second downstream passage configured to communicate the second upstream passage with an intake port of a second cylinder head. The upstream portion, the first downstream portion, and the second downstream portion are provided in a separate manner. In the intake manifold, a flange of the first downstream portion is connected to a flange of the upstream portion, and a flange of the second downstream portion is connected to the flange of the upstream portion.

6 Claims, 2 Drawing Sheets

(51) Int. Cl.
*B22D 23/02* (2006.01)
*F02M 35/104* (2006.01)
*F02M 35/108* (2006.01)

(58) Field of Classification Search
CPC ..... F02M 35/10052; F02M 35/10091; F02M 35/10098; F02M 35/10104; F02M 35/10111; F02M 35/10144; F02M 35/1015; F02M 35/10216; F02M 35/10354; F02M 35/104; F02M 35/108
See application file for complete search history.

(56) References Cited

U.S. PATENT DOCUMENTS

2008/0313904 A1 12/2008 Peffley et al.
2014/0338627 A1* 11/2014 Yamaguchi ..... F02M 35/104 123/184.21
2014/0338629 A1* 11/2014 Kato ..... F02M 35/10354 123/184.61

* cited by examiner

INTAKE MANIFOLD FOR INTERNAL COMBUSTION ENGINE

CROSS-REFERENCE TO RELATED APPLICATIONS

This application claims priority to Japanese Patent Application No. 2016-159269 filed on Aug. 15, 2016, which is incorporated herein by reference in its entirety.

BACKGROUND

1. Technical Field

This disclosure relates to an intake manifold for a V-type internal combustion engine.

2. Description of Relined Art

As described in Japanese Patent Application Publication No. 2010-014018 (JP 2010-014018 A), in a V-type internal combustion engine, an intake manifold is provided between a first cylinder head an a first bank side and a second cylinder head on a second bank side. Intake air from outside is supplied from the intake manifold to an intake port of the first cylinder head and an intake port of the second cylinder head. Further, the intake manifold includes: an upstream portion including a first upstream passage and a second upstream passage into which the intake air from outside is introduced; a first downstream portion including a first downstream passage configured to communicate the first upstream passage with the intake port of the first cylinder head; and a second downstream portion including a second downstream passage configured to communicate the second upstream passage with the intake port of the second cylinder head. In the first downstream portion, a downstream end of the first downstream passage is connected to the first cylinder head. In the second downstream portion, a downstream end of the second downstream passage is connected to the second cylinder head. In the intake manifold described in JP 2010-014018 A, the upstream portion, the first downstream portion, and the second downstream portion are formed integrally so as to form a shape extending from the first cylinder to the second cylinder head as a whole.

SUMMARY

Upon receipt of heat caused due to combustion of a fuel/air mixture in a combustion chamber of the internal combustion engine, the internal combustion engine thermally expands outward so that the first cylinder head and the second cylinder head are displaced in directions to be distanced from each other. Note that, at this time, the intake manifold also thermally expands, but an extent a the thermal expansion of the cylinder head or the cylinder block closer to the combustion chamber in terms of distance is larger than that of the intake manifold. On this account, in the intake manifold described in JP 2010-014018 A, when such a thermal expansion occurs, the first downstream portion and the second downstream portion are pulled so as to be distanced from each other via their respective connection portions with the cylinder heads. When such a force acts, a stress is applied to the respective connection portions with the cylinder heads in the first downstream portion and the second downstream portion of the intake manifold. Accordingly, the connection portions with the first downstream portion and the second downstream portion are displaced, so that sealing characteristics of the connection portions might decrease.

The present disclosure has been accomplished in consideration of the above-mentioned circumstances, and intends to restrain a decrease in a sealing characteristic of a connection portion of a downstream portion of an intake manifold with a cylinder head, the decrease in the sealing characteristic being caused due to thermal expansion of an internal combustion engine.

In view of this, one aspect of the present disclosure provides an intake manifold for an internal combustion engine, the intake manifold including an upstream portion, a first downstream portion, and a second downstream portion. The internal combustion engine includes a first cylinder on a first bank side and a second cylinder on a second bank side, and the first cylinder and the second cylinder are inclined so as to approach each other toward a side closer to a crankshaft. The intake manifold is provided between a first cylinder head on a first bank side and a second cylinder head on a second bank side in the internal combustion engine. The intake manifold is configured to supply intake air from outside to an intake port of the first cylinder head and an intake port of the second cylinder head. The upstream portion of the intake manifold includes a first upstream passage and a second upstream passage into which the intake air from outside is introduced. The first downstream portion includes a first downstream passage configured to communicate the first upstream passage with an intake port of the first cylinder head. The second downstream portion includes a second downstream passage configured to communicate the second upstream passage with an intake port of the second cylinder head. Further, (i) the upstream portion, the first downstream portion, and the second downstream portion are provided separately, (ii) an upstream end of the first downstream portion is connected to a first downstream end of the upstream portion, and the first upstream passage is opened in the first downstream end, and (iii) an upstream end of the second downstream portion is connected to a second downstream end of the upstream portion, and the second upstream passage is opened in the second downstream end.

With the configuration of the intake manifold, when the internal combustion engine thermally expands and the cylinder heads are distanced from each other, not only a positional displacement in a connection portion between the downstream end of the first downstream portion and the first cylinder head, but also a positional displacement in a connection portion between the upstream end of the first downstream portion and the downstream end of the upstream portion might occur. By dispersing the parts where a positional displacement occurs as such, it is possible to reduce a degree of the positional displacement in the downstream end of the first downstream portion. Accordingly, it is possible to restrain an excessive positional displacement that might decrease a sealing characteristic in the downstream end of the first downstream portion. The same can be said about the second downstream portion.

Further, in the intake manifold, the upstream portion is formed by a gravity casting process, and the first downstream portion and the second downstream portion are formed by die casting. With such an intake manifold, it is possible to reduce thicknesses of respective side walls of the first downstream passage and the second downstream passage in the internal combustion engine, thereby making it possible to achieve a weight reduction of the intake manifold.

Further, in the intake manifold, the upstream portion is formed by die casting, and the first downstream portion and the second downstream portion are formed by gravity casting. With such an intake manifold, it is possible to reduce thicknesses of respective side walls of the first downstream passage and the second downstream passage in the internal combustion engine, thereby making it possible to achieve a weight reduction of the intake manifold.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

An embodiment as an example of an intake manifold for an internal combustion engine is described below with reference to FIGS. 1 and 2. Note that, in the following description, an "upstream" side of an intake air flow is merely referred to as the "upstream" side and a "downstream" side of the intake air flow is merely referred to as the "downstream" side.

Figure 1:
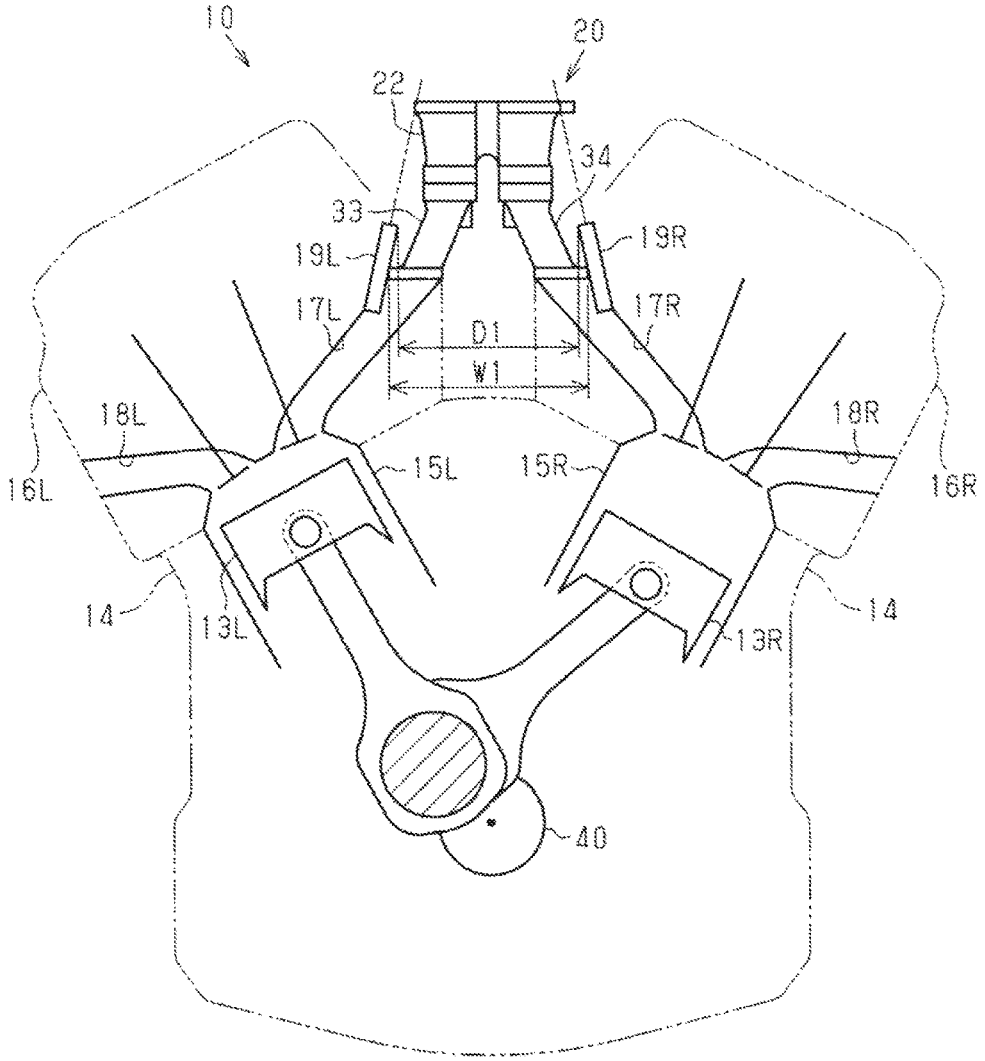
FIG. 1 is a schematic view of an internal combustion engine to which an intake manifold of an embodiment as an example of the present disclosure is applied.

As illustrated in FIG. 1, a cylinder block 14 of an internal combustion engine 10 is provided with three cylinders 15L constituting a cylinder line on a first bank side and three cylinders 15R constituting a cylinder line on a second bank side. Note that FIG. 1 illustrates one cylinder 15L on the first bank side and one cylinder 15R on the second bank side. The cylinder 15L on the first bank side and the cylinder 15R on the second bank side are inclined so as to approach each other toward a side closer to a crankshaft 40, which is an output shaft of the internal combustion engine 10. That is, the internal combustion engine 10 is a so-called V-type in combustion engine.

Inside the cylinder 15L on the first bank side, a piston 13L is provided so as to reciprocate in the cylinder 15L. Similarly, inside the cylinder 15R on the second bank side, a piston 13R is provided so as to reciprocate in the cylinder 15R. The pistons 13L, 13R are connected to the crankshaft 40, so that the crankshaft 40 rotates along with the reciprocations of the pistons 13L, 13R.

A first cylinder head 16L is fixed to the cylinder block 14 so as to correspond to the cylinders 15L on the first bank side. Further, a second cylinder head 16R is fixed to the cylinder block 14 so as to correspond to the cylinders 15R on the second bank side.

The first cylinder head 16L is provided with an intake port 17L configured to supply intake air to a combustion chamber of the cylinder 15L of the cylinder block 14, and an exhaust port 18L configured to discharge exhaust gas from the combustion chamber of the cylinder 15L. The intake port 17L is opened in a part of the first cylinder head 16L on a side closer to the second cylinder head 16R than a center of the first cylinder head 16L. Further, the intake port 17L is provided with a fuel injection valve 19L configured to inject and supply fuel into the intake port 17L.

Further, the second cylinder head 16R is provided with an intake port 17R configured to supply the intake air to a combustion chamber of the cylinder 15R of the cylinder block 14, and an exhaust port 18R configured to discharge exhaust gas from the combustion chamber of the cylinder 15R. The intake port 17R is opened in a part of the second cylinder head 16R on a side closer to the first cylinder head 16L than a center of the second cylinder head 16R. Further, the intake port 17R is provided with a fuel injection valve 19R configured to inject and supply the fuel into the intake port 17R. Note that the fuel injection valves 19L, 19R in the internal combustion engine 10 are provided in an inclined manner so as to be distanced from each other toward their tip end sides to be inserted into the intake ports 17L, 17R.

An intake manifold 20 that connects the intake ports 17L, 17R to a surge tank (not shown) in which the intake air from outside is stored temporarily is provided between the first cylinder head 16L and the second cylinder head 16R in the internal combustion engine 10. The intake manifold 20 is constituted by an upstream portion 22, a first downstream portion 33, and a second downstream portion 34. The upstream portion 22, the first downstream portion 33, and the second downstream portion 34 are provided separately.

Figure 2:
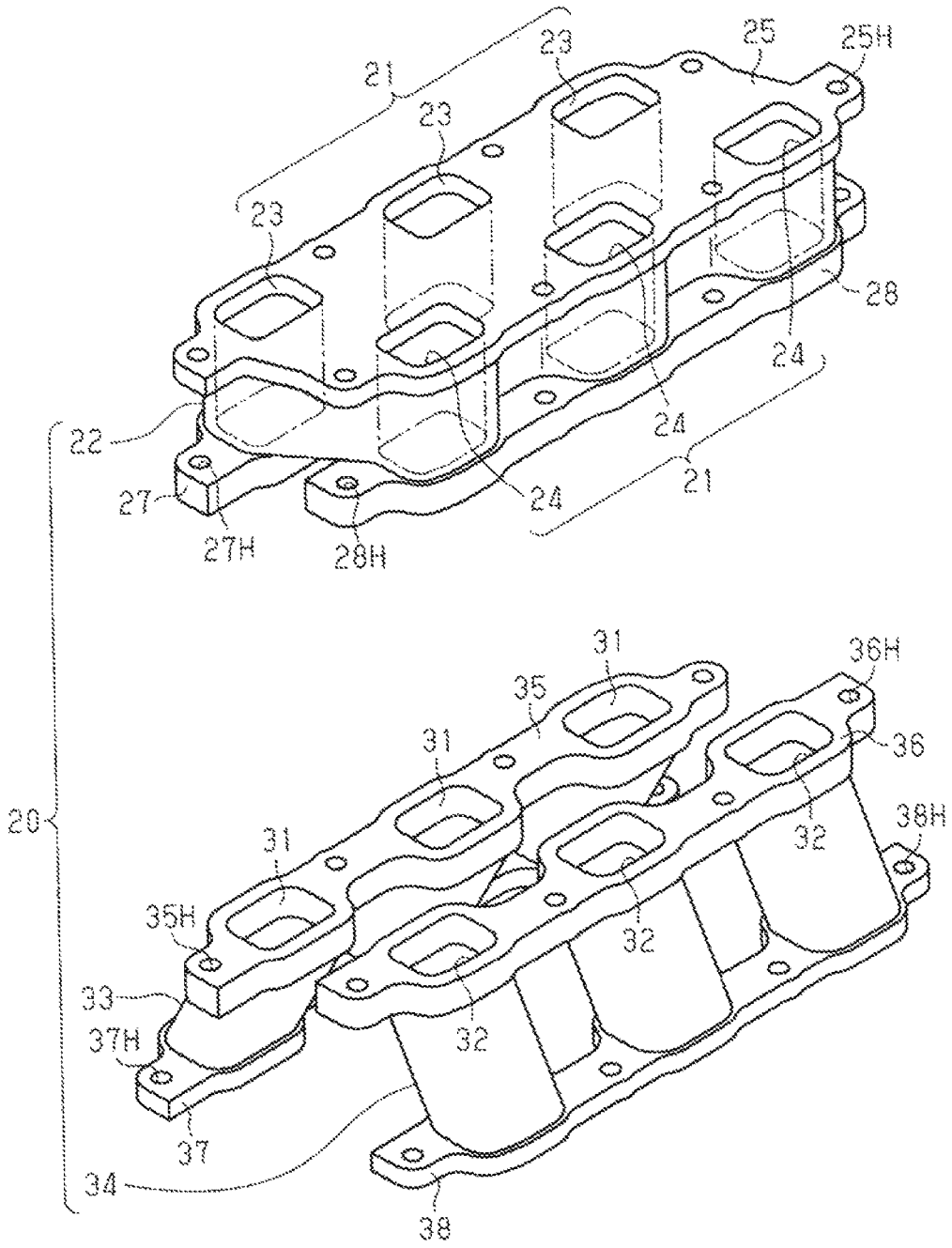
FIG. 2 is an exploded perspective view of the intake manifold illustrated in FIG. 1.

As illustrated in FIG. 2, an upstream passage 21 is provided inside the upstream portion 22. The upstream passage 21 is constituted by three first upstream passages 23 provided for the cylinders 15L on the first bank side, and three second upstream passages 24 provided for the cylinders 15R on the second bank side. Inside the upstream portion 22, the first upstream passages 23 and the second upstream passages 24 are provided side by side such that the first upstream passages 23 are arranged in line and the second upstream passages 24 are arranged in line.

In an upstream end (an upper end in FIG. 2) in the upstream portion 22, a flange 25 is provided so as to project outside the upstream portion 22. Respective upstream ends of six passages in total, i.e., the three first upstream passages 23 and the three second upstream passages 24, are opened in the flange 25. Further, the flange 25 has eight bolt holes 25H into which respective bolts are inserted at the time of connecting the upstream portion 22 to the surge tank.

In a downstream end (a lower end in FIG. 2) in the upstream portion 22, a flange 25 is provided as a first downstream end so as to project from a position corresponding to downstream ends of the first upstream passages 23 toward outside the upstream portion 22. Similarly, in the downstream end in the upstream portion 22, a flange 28 is provided as a second downstream end so as to project from a position corresponding to downstream ends of the second upstream passages 24 toward outside the upstream portion 22. Downstream ends of all the first upstream passages 23 are opened in the flange 27, and downstream ends of all the second upstream passages 24 are opened in the flange 28. Further, the flange 27 has four bolt holes 27H and the flange 28 has four bolt holes 28H. Note that the upstream portion 22 of the intake manifold 20 is provided by a gravity casting process in which molten metal is poured into a die by use of gravity (an atmospheric pressure).

The first downstream portion 33 includes three first downstream passages 31 provided for the cylinders 15L on the first bank side. In an upstream end (an upper end in FIG. 2) in the first downstream portion 33, a flange 35 is provided so as to project outside the first downstream portion 33. Upstream ends of all the first downstream passages 31 are opened in the flange 35. Further, in a downstream end (a lower end in FIG. 2) in the first downstream portion 33, a flange 37 is provided so as to project outside the first downstream portion 33. Downstream ends of all the first downstream passages 31 are opened in the flange 37. Note that the flange 35 has four bolt boles 35H and the flange 37 has four bolt holes 37H.

Further, the second downstream portion 34 includes three second downstream passages 32 provided for the cylinders 15R on the second bank side. In an upstream end (an upper end in FIG. 2) in the second downstream portion 34, a flange 36 is provided so as to project outside the second downstream portion 34. Upstream ends of all the second downstream passages 32 are opened in the flange 36. Further, in a downstream end (a lower end in FIG. 2) in the second downstream portion 34, a flange 38 is provided so as to project outside the second downstream portion 34. Downstream ends of all the second downstream passages 32 are opened in the flange 38. Note that the flange 36 has four bolt holes 36H and the flange 38 has four bolt holes 38H.

Note that the first downstream portion 33 and the second downstream portion 34 of the intake manifold 20 are provided by die casting in which molten metal is filled into a die by applying a high pressure. In the intake manifold 20, the flange 27 in the upstream portion 22 is fixed to the flange 35 in the first downstream portion 33 with bolts, so that the first upstream passage 23 is connected to the first downstream passage 31. In the intake manifold 20, the flange 28 in the upstream portion 22 is fixed to the flange 36 in the second downstream portion 34 with bolts, so that the second upstream passage 24 is connected to the second downstream passage 32. Note that the first downstream portion 33 and the second downstream portion 34 are provided such that their downstream sides are distanced from each other as compared with their upstream sides in a state where they are connected to the upstream portion 22 as such.

In the internal combustion engine 10, the flange 25 in the upstream portion 22 of the intake manifold 20 is fixed to the surge tank with bolts. Hereby, the first upstream passage 23 and the second upstream passage 24 communicates with the surge tank is the upstream portion 22.

Then, the flange 37 in the first downstream portion 33 is fixed to the first cylinder head 16L with bolts, so that the first downstream passage 31 is connected to the intake port 17L of the first cylinder head 16L. That is, the first upstream passage 23 communicates with the intake port 17L of the first cylinder head 16L via the first downstream passage 31.

Further, the flange 38 in the second downstream portion 34 is fixed to the second cylinder head 16R with bolts, so that the second downstream passage 32 is connected to the intake port 17R of the second cylinder head 16R. That is, the second upstream passage 24 communicates with the intake port 17R of the second cylinder head 16R via the second downstream passage 32.

Note that a part between the flange 27 in the upstream portion 22 and the flange 35 in the first downstream portion 33 and a part between the flange 28 in the upstream, portion 22 and the flange 36 in the second downstream portion 34 are sealed by liquid gasket. Similarly, a part between the flange 37 in the first downstream portion 33 and the first cylinder head 16L and a part between the flange 38 in the second downstream portion 34 and the second cylinder head 16R are also sealed by liquid gasket.

In such an intake manifold 20, the intake air from outside is first introduced into the first upstream passage 23 and the second upstream passage 24 via the surge tank. Then, the intake air is supplied to the intake ports 17L, 17R of the first cylinder head 16L and the second cylinder head 16R from the first upstream passage 23 and the second upstream passage 24 via the first downstream passage 31 and the second downstream passage 32.

When the intake manifold 20 is assembled to the cylinder heads 16L, 16R in the internal combustion engine 10, the first downstream portion 33 is assembled to the first cylinder head 16L, and then, the fuel injection valve 19L is attached to the first cylinder head 16L so as to be able to inject the fuel into the intake port 17L. Further, after the second downstream portion 34 is assembled to the second cylinder head 16R, the fuel injection valve 19R is attached to the second cylinder head 16R so as to be able to inject the fuel into the intake port 17R. Then, the upstream portion 22 is assembled to the first downstream portion 33 and the second downstream portion 34.

Next will be described an operation and an effect of the intake manifold 20. When the fuel/air burns in the combustion chambers of the cylinders 15L, 15R in the internal combustion engine 10, the internal combustion engine 10 thermally expands outward along with that. Hereby, the cylinder heads 16L, 16R are displaced in directions to be distanced from each other. Note that a temperature of the intake manifold does not become as high as temperatures of the cylinder block 14 and the cylinder heads 16L, 16R because a distance of the intake manifold 20 from the cylinders 15L, 15R is farther as compared with distances of the cylinder block 14 and the cylinder heads 16L, 16R therefrom, and further the intake air circulates through the intake manifold 20. Accordingly, in the internal combustion engine 10, a degree of thermal expansion of the cylinder block 14 and the cylinder heads 16L, 16R tends to be larger than a degree of thermal expansion of the intake manifold 20. Accordingly, when such thermal expansion occurs, the first downstream portion 33 and the second, downstream portion 34 are pulled so as to be distanced from each other via their respective connection portions with the cylinder heads 16L, 16R.

In the intake manifold 20, when the internal combustion engine 10 thermally expands and the cylinder heads 16L, 16R are displaced in the directions to be distanced from each other, not only a positional displacement in a connection portion between the flange 37 in the first downstream portion 33 and the first cylinder head 16L, but also a positional displacement between the flange 35 of the first downstream portion 33 and the flange 27 of the upstream portion 22 might occur. By dispersing the parts where a positional displacement occurs as such, it is possible to reduce a degree of the positional displacement in the flange 37 of the first downstream portion 33. Accordingly, it is possible to restrain an excessive positional displacement that might decrease a sealing characteristic in the flange 37 of the first downstream portion 33.

The same can be said about the second downstream portion 34. That is, when the internal combustion engine 10 thermally expands and the cylinder heads 16L, 16R are displaced in the directions to be distanced from each other, not only a positional displacement in a connection, portion between the flange 38 in the second downstream portion 34 and the second cylinder head 16R but also a positional displacement between the flange 36 of the second downstream portion 34 and the flange 28 of the upstream portion 22 might occur. By dispersing the parts where a positional displacement occurs as such, it is possible to reduce a degree of the positional displacement in the flange 38 of the second downstream portion 34. Accordingly, it is possible to restrain an excessive positional displacement that might decrease a sealing characteristic in the flange 38 of the second downstream portion 34.

In the meantime, in the internal combustion engine 10, under the influence of restriction of a disposition space, and the like, the fuel injection valves 19L, 19R are provided so as to be inclined along the first downstream portion 33 and the second downstream portion 34, at a position close to the first downstream portion 33 and the second downstream portion 34, as illustrated in FIG. 1. Note that, as illustrated in FIG. 1, a width W1 of the downstream end of the intake manifold 20 is larger than a distance D1 between rear ends (upper ends in FIG. 1) of the fuel injection valves 19L, 19R. Accordingly, if a conventional intake manifold in which the upstream portion 22, the first downstream portion 33, and the second downstream portion 34 are formed integrally is provided in the internal combustion engine 10 from above after assembling of the fuel injection valves 19L, 19R, the intake manifold interferes with the fuel injection valves 19L, 19R. On this account, in a case where a conventional intake manifold is provided in the internal combustion engine 10, it could not help employing, as an assembling order, such an order of assembling the fuel injection valves 19L, 19R to the intake ports 17L, 17R after assembling the intake manifold to the cylinder head 16L, 16R.

In contrast, in the intake manifold 20, the first downstream portion 33 and the second downstream portion 34 that might interfere with the fuel injection valves 19L, 19R at the time of assembling are provided as different members from the upstream portion 22. On this account, as the assembling order, it is possible to employ an order of assembling the fuel injection valves 19L, 19R after the first downstream portion 33 and the second downstream portion 34 are assembled. Of course, it is possible to employ an order of assembling the upstream portion 22 after the first downstream portion 33 and the second downstream portion 34 are assembled, and then assembling the fuel injection valves 19L, 19R after the upstream portion 22 is assembled. That is, in the internal combustion engine 10 equipped with the intake manifold 20, the assembling order of the intake manifold 20 and the fuel injection valves 19L, 19R can be selected from more assembling orders than the conventional technique, and a degree of freedom of the assembling order improves.

Note that the upstream portion 22 in the intake manifold 20 is positioned on an extension line (an alternate long and short dash line in FIG. 1) of a movement locus at the time when the tip ends of the fuel injection valves 19L, 19R are inserted into the cylinder heads 16L, 16R. Accordingly, like the conventional technique, in a case where the intake manifold is assembled to the cylinder heads 16L, 16R and then, the fuel injection valves 19L, 19R are assembled, when the tip ends of the fuel injection valves 19L, 19R are inserted into the cylinder heads 16L, 16R, the upstream portion 22 of the intake manifold interferes, so that the operation is difficult to perform. In this regard, in the case of the intake manifold 20, the fuel injection valves 19L, 19R can be assembled after the first downstream portion 33 and the second downstream portion 34 are assembled, and then, the upstream portion 22 can be assembled. When the assembling is performed in such an order, the upstream portion 22 does not interfere at the time when the tip ends of the fuel injection valves 19L, 19R are inserted into the cylinder heads 16L, 16R.

Further, the intake manifold 20 is configured such that the upstream portion 22, the first downstream portion 33, and the second downstream portion 34 are provided in a divided manner. Here, the upstream portion 22 includes six passages constituted by two lines of the first upstream passages 23 and the second upstream passages 24. In the meantime, the first downstream portion 33 and the second downstream portion 34 each include three passages arranged in line, e.g., the first downstream passages 31 and the second downstream passages 32. As such, the first downstream portion 33 and the second downstream portion 34 have a relatively simple shape as compared with the upstream portion 22, so that the first downstream portion 33 and the second downstream portion 34 of the intake manifold 20 can be provided by die casting.

Like the above intake manifold 20, the first downstream portion 33 and the second downstream portion 34 provided by the die casting can be configured such that the first downstream passage 31 and the second downstream passage 32 have a side wall with a small thickness in comparison with those provided by a gravity casting process. When the side walls of the first downstream passage 31 and the second downstream passage 32 are reduced in thickness, it is possible to achieve a weight reduction of the intake manifold 20.

Note that the intake manifold 20 is configured such that the upstream portion 22, the first downstream portion 33, and the second downstream portion 34 are provided in a divided manner, so that a positional displacement might occur between the downstream end of the upstream portion 22 and the upstream end of the first downstream portion 33 or the second downstream portion 34. Due to the positional displacement, a stress in the intake manifold 20 is relaxed, so that it is possible to reduce a thickness of each part in comparison with the intake manifold in which the upstream portion 22, the first downstream portion 33, and the second downstream portion 34 are formed integrally, like the conventional intake manifold. Accordingly, from such a viewpoint, in comparison with the conventional intake manifold, the above configuration is advantageous in order to achieve the weight reduction of the intake manifold 20.

Further, the first downstream portion 33 and the second downstream portion 34 provided by the die casting can be configured such that the first downstream passage 31 and the second downstream passage 32 are provided with smooth inner surfaces, in comparison with those provided by the gravity casting process. On this account, it is possible to reduce a resistance that the intake air receives on the inner surfaces of the first downstream passage 31 and the second downstream passage 32 at the time when the intake air passes through the first downstream passage 31 and the second downstream passage 32.

Note that the above embodiment can be modified to the following other embodiments.

- The fuel injection valves 19L, 19R may be assembled to the intake ports 17L, 17R after the first downstream portion 33, the second downstream portion 34, and the upstream portion 22 are assembled to the cylinder heads 16L, 16R.
- In a case where a sufficient disposition space can be secured, the fuel injection valves 19L, 19R can be provided at a position more distanced from the first downstream portion 33 and the second downstream portion 34, or can be provided in a state where the fuel injection valves 19L, 19R are not along the first downstream portion 33 and the second downstream portion 34. With such an embodiment, even if the intake manifold 20 is assembled to the cylinder heads 16L, 16R after the fuel injection valves 19L, 19R are assembled to the intake ports 17L, 17R, the fuel injection valves 19L, 19R are less likely to interfere with the first downstream portion 33 and the second downstream portion 34 at the time of assembling.

The first downstream portion 33 and the second downstream portion 34 may be provided by the gravity casting process.

If the shape of the upstream portion 22 is a shape that can be formed by the die casting, the upstream portion 22 may be provided by the die casting.

In the downstream end of the upstream portion 22, all the first upstream passages 23 and the second upstream passages 34 may be opened in one common flange. In such an embodiment, a part where the first upstream passages 23 are opened in the one flange in the downstream end of the upstream portion 22 is assumed a first downstream end, and this part is connected to the first downstream portion 33. Further, a part where the second upstream passages 24 are opened in the one flange in the downstream end of the upstream portion 22 is assumed a second downstream end, and this part is connected to the second downstream portion 34.

The flange 25 provided in the upstream portion 22 may be omitted. Further, the flanges provided in the downstream end of the upstream portion 22, such as the flange 27 and the flange 28 in the upstream portion 22, may be omitted. In an embodiment in which the flanges provided in the downstream end of the upstream portion 22 are omitted, a part where the first upstream passages 23 are opened in the downstream end of the upstream portion 22 is assumed a first downstream end, and this part is connected to the first downstream portion 33. Further, a part where the second upstream passages 24 are opened in the downstream end of the upstream portion 22 is assumed a second downstream end, and this part is connected to the second downstream portion 34. As such, even in a case where the flanges provided in the downstream end of the upstream portion 22 are omitted, if such a configuration is employed that the downstream end of the upstream portion 22 is connected to the upstream end of the first downstream portion 33 and the upstream end of the second downstream portion 34 in a state where a positional displacement is allowable, a positional displacement might occur between the downstream end of the upstream portion 22 and the upstream end of the first downstream portion 33 or the second downstream portion 34. On this account it is possible to disperse parts where a positional displacement occurs in the intake manifold 20.

The flange 35 provided in the first downstream portion 33 or the flange 36 provided in the second downstream portion 34 may be omitted. Even in a case where the flange 35 or the flange 36 is omitted as such, if such a configuration is employed that the upstream end of the first downstream portion 33 or the upstream end of the second downstream portion 34 is connected to the downstream end of the upstream portion 22 in a state where a positional displacement is allowable, a positional displacement might occur between the upstream end of the first downstream portion 33 or the upstream end of the second downstream portion 34 and the downstream end of the upstream portion 22. On this account, it is possible to disperse parts where a positional displacement occurs in the intake manifold 20.

It is also conceivable that the connection between the downstream end of the upstream portion 22 and the upstream end of the first downstream portion 33 or the connection between the downstream end of the upstream portion 22 and the upstream end of the second downstream portion 34 is performed by a connection method such as welding, except for bolt fastening. Note that, even in a case where the connection is performed by welding, when the cylinder heads 16L, 16R are distanced from each other, a positional displacement might occur between the downstream end of the upstream portion 22 and the upstream end of the first downstream portion 33 or between the downstream end of the upstream portion 22 and, the upstream end of the second downstream portion 34, depending on a welding state. On this account, if the downstream end of the upstream portion 22 is welded to the upstream end of the first downstream portion 33 or the upstream end of the second downstream portion 34 with such a welding state, it is possible to obtain the same effect as the above embodiment.

The flange 37 provided in the first downstream portion 33 or the flame 38 provided in the second downstream portion 34 may be omitted. Even in a case where the flange 37 or the flange 38 is omitted as such, it is possible to employ a configuration in which the downstream end of the first downstream portion 33 is connected to the first cylinder head 16L. Further, it is possible to employ a configuration in which the downstream end of the second downstream portion 34 is connected to the second cylinder head 16R.

It is also conceivable that the connection between the downstream end of the first downstream portion 33 and the first cylinder head 16L or the connection between the downstream end of the second downstream portion 34 and the second cylinder head 16R is performed by a connection method such as welding, except for bolt fastening. Note that, even in a case where the connection is performed by welding, when the cylinder heads 16L, 16R are distanced from each other, a positional displacement might occur between the downstream end of the first downstream portion 33 and the first cylinder head 16L or between the downstream end of the second downstream portion 34 and the second cylinder head 16R, depending on a welding state. On this account, in a case where the downstream end of the first downstream portion 33 or the second downstream portion 34 is welded to the cylinder head 16L, 16R with such a welding state, if the connection state between the downstream end of the upstream portion 22 and the upstream end of the first downstream portion 33 or the second downstream portion 34 in the above embodiment or the modifications is employed, it is possible to obtain the same effect as the above embodiment.

The first downstream portion 33 and the second downstream portion 34 may be further divided in the middle of an intake an flow direction of the first downstream passage 31 and the second downstream passage 32. In such an embodiment, the number of parts where a positional displacement occurs in the intake manifold 20 further increases thereby making it possible to further disperse parts where a positional displacement occurs in the intake manifold 20.

The upstream portion 22 may be further divided in the middle of an intake air flow direction of the first upstream passage 23 or the second upstream passage 24. Even with such a configuration, the number of parts where a positional displacement occurs in the intake manifold 20 further increases.

The above description exemplifies the intake manifold 20 to be provided in the internal combustion engine 10 including the fuel injection valves 19L, 19R configured to inject and supply the fuel into the intake ports 17L, 17R. The configuration similar to the above intake manifold 20 may be applied to an intake manifold for an internal combustion engine including a fuel injection valve configured to inject and supply fuel into a cylinder, instead of the fuel injection valves 19L, 19R or in addition to the fuel injection valves 19L, 19R.

The configuration similar the above intake manifold 20 can be also applied to an intake manifold for other V-type internal combustion engines except for the V-6 internal combustion engine 10, e.g., a V-4 internal combustion engine and a V-8 internal combustion engine.

What is claimed is:

1. An internal combustion engine, comprising:

a first cylinder head on a first bank side of a cylinder block, the first cylinder head being fixed to the cylinder block so as to correspond to a first cylinder on the first bank side;

a second cylinder head on a second bank side of the cylinder block, the second cylinder head being fixed to the cylinder block so as to correspond to a second cylinder on the second bank side;

an intake manifold provided between the first cylinder head and the second cylinder head the intake manifold being configured to supply intake air from outside to an intake port of the first cylinder head and an intake port of the second cylinder head;

a first fuel injection valve configured to inject and supply fuel into the intake port of the first cylinder head; and a second fuel injection valve configured to inject and supply fuel into the intake port of the second cylinder head, wherein the internal combustion engine is a V-type internal combustion engine, wherein the intake manifold includes:

an upstream portion including a first upstream passage and a second upstream passage into which the intake air from outside is introduced;

a first downstream portion including a first downstream passage configured to communicate the first upstream passage with the intake port of the first cylinder head; and a second downstream portion including a second downstream passage configured to communicate the second upstream passage with the intake port of the second cylinder head, wherein the upstream portion, the first downstream portion, and the second downstream portion are provided separately, wherein an upstream end of the first downstream portion is connected to a first downstream end of the upstream portion, and the first upstream passage is opened in the first downstream end, wherein an upstream end of the second downstream portion is connected to a second downstream end of the upstream portion, and the second upstream passage is opened in the second downstream end, wherein the first fuel injection valve is provided in the intake port of the first cylinder head, and the second fuel injection valve is provided in the intake port of the second cylinder head, and wherein a width of a downstream end of the intake manifold is larger than a distance between a rear end of the first fuel injection valve and a rear end of the second fuel injection valve.

2. The internal combustion engine according to claim 1, wherein:

the upstream portion is formed by a gravity casting process; and the first downstream portion and the second downstream portion are formed by die casting.

3. The internal combustion engine according to claim 1, wherein:

the upstream portion is formed by die casting; and the first downstream portion and the second downstream portion are formed by a gravity casting process.

4. The internal combustion engine according to claim 1, wherein the first fuel injection valve and the second fuel injection valve are respectively inclined along the first downstream portion and the second downstream portion such that the distance between the rear end of the first fuel injection valve and the rear end of the second fuel injection valve is less than a distance between a front end of the first fuel injection valve and a front end of the second fuel injection valve.

5. The internal combustion engine according to claim 4, wherein the distance between the front end of the first fuel injection valve and the front end of the second fuel injection valve is larger than the width of the downstream end of the intake manifold.

6. The internal combustion engine according to claim 1, wherein a downstream end of the first upstream passage opens in a first flange, and a downstream end of the second upstream passage opens in a second flange.

* * * * *